US010706786B2

(12) United States Patent
Jang et al.

(10) Patent No.: US 10,706,786 B2
(45) Date of Patent: Jul. 7, 2020

(54) GATE DRIVER AND ORGANIC LIGHT EMITTING DISPLAY DEVICE INCLUDING THE SAME

(71) Applicant: LG DISPLAY CO., LTD., Seoul (KR)

(72) Inventors: YongHo Jang, Goyang-si (KR); WooSeok Choi, Seoul (KR); KwangIl Chun, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/176,142

(22) Filed: Oct. 31, 2018

(65) Prior Publication Data

US 2019/0130842 A1 May 2, 2019

(30) Foreign Application Priority Data

Nov. 1, 2017 (KR) ..... 10-2017-0144927

(51) Int. Cl.
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0814* (2013.01); *G09G 2300/0861* (2013.01); *G09G 2310/0251* (2013.01); *G09G 2310/0262* (2013.01); *G09G 2310/0286* (2013.01); *G09G 2310/06* (2013.01); *G09G 2310/08* (2013.01)

(58) Field of Classification Search
CPC ... G09G 2310/0286; G09G 2300/0861; G09G 2300/0814; G09G 3/3233
See application file for complete search history.

(56) References Cited

U.S. PATENT DOCUMENTS

2013/0038621 A1* 2/2013 Choi ..... G06T 1/20 345/589
2014/0375616 A1* 12/2014 Kim ..... G09G 3/3266 345/211
2016/0117981 A1* 4/2016 Lee ..... G09G 3/3233 345/214

* cited by examiner

*Primary Examiner* — Abbas I Abdulselam
(74) *Attorney, Agent, or Firm* — Polsinelli PC

(57) ABSTRACT

According to an aspect of the present disclosure, a gate driver includes a plurality of stages which is dependently connected to each other and each of the plurality of pixels includes: a first output unit which outputs a sensing signal by voltages of a Q node and a QB node; a second output unit which outputs a reference signal by the voltages of the Q node and the QB node; a third output unit which outputs a scan signal by the voltages of the Q node and the QB node; a first controller which controls the Q node; and a second controller which controls the QB node, and at least two of the first to third output units share at least one clock signal among a plurality of clock signals, thereby reducing an area of the gate driver.

9 Claims, 8 Drawing Sheets

GATE DRIVER AND ORGANIC LIGHT EMITTING DISPLAY DEVICE INCLUDING THE SAME

CROSS-REFERENCE TO RELATED APPLICATION

This application claims the priority of Korean Patent Application No. 10-2017-0144927 filed on Nov. 1, 2017, in the Korean Intellectual Property Office, the disclosure of which is incorporated herein by reference in its entirety.

BACKGROUND

Field of the Disclosure

The present disclosure relates to a gate driver, and more particularly, to a gate driver which shares a clock signal and an organic light emitting display device including the same.

Description of the Background

As the information society develops, the demand for display devices which display images is increasing in various forms. Therefore, recently, various flat panel display devices (FPD) which are capable of reducing a weight and a volume which are disadvantages of cathode ray tubes have been developed and marketed. For example, various display devices such as a liquid crystal display device (LCD) or an organic light emitting diode (OLED) display device are utilized. A display panel of the display device includes a plurality of pixels which is defined by gate lines and data lines. The display device displays images using a gate driver which supplies scan signals to the gate lines and a data driver which supplies data voltages to the data lines. The display device controls operation timings of the gate driver and the data driver using a timing controller. The data driver converts digital image data supplied from the timing controller into an analog data voltage to output the converted analog data voltage under the control of the timing controller.

The gate driver includes a shift register to sequentially output the scan signals. The shift register is configured by a plurality of stages which is dependently connected to each other. The plurality of stages sequentially outputs the scan signals to sequentially scan the gate lines disposed on the display panel. Such a gate driver may be disposed in a gate in panel (GIP) type to be embedded in a thin film transistor (TFT) array substrate of a display panel for integration of a display panel.

A plurality of pixels disposed on the display panel is applied with the plurality of scan signals output from the plurality of stages of the gate driver to be driven. That is, the plurality of scan signals is divided in the display panel to be applied to the plurality of TFTs which is provided in the pixels, respectively.

As described above, in order to divide the plurality of scan signals in the display panel, the gate lines need to be dependently connected to each other. Therefore, a load in the gate driver is increased. Therefore, in the gate driver, the output of the scan signal is undesirably delayed. Further, since the gate lines need to be dependently connected to each other, a size of the gate driver is correspondingly increased so that there may be a problem to install the gate driver in the thin film transistor (TFT) array substrate.

SUMMARY

The present disclosure is to provide a GIP type gate driver having a small size and an organic light emitting display device including the same.

The present disclosure is not limited to the above-mentioned objects, and other objects, which are not mentioned above, can be clearly understood by those skilled in the art from the following descriptions.

In order to solve the above-described problems, according to an aspect of the present disclosure, a gate driver includes a plurality of stages which is dependently connected to each other and each of the plurality of pixels includes: a first output unit which outputs a sensing signal by voltages of a Q node and a QB node; a second output unit which outputs a reference signal by the voltages of the Q node and the QB node; a third output unit which outputs a scan signal by the voltages of the Q node and the QB node; a first controller which controls the Q node; and a second controller which controls the QB node, and at least two of the first to third output units share at least one clock signal among a plurality of clock signals, thereby reducing an area of the gate driver.

In order to solve the above-described problems, according to another aspect of the present disclosure, an organic light emitting display device includes: a display panel including a plurality of pixels; and a gate driver which is mounted in the display panel and shares at least one clock signal among a plurality of clock signal to output a sensing signal, a reference signal, and a scan signal, thereby reducing an area of the gate driver.

Other detailed matters of the exemplary aspects are included in the detailed description and the drawings.

According to the exemplary aspect of the present disclosure, in an organic light emitting display device, a clock signal is shared in a gate driver to output a reference signal, a scan signal, and a sensing signal. Therefore, a gate driver embedded in the display panel is simplified so that a bezel size is reduced. Further, outputs of the reference signal, the scan signal, and the sensing signal are maintained to be separated in the gate driver so that an output load is reduced, thereby suppressing the delay of the signal.

The effects according to the present disclosure are not limited to the contents exemplified above, and more various effects are included in the present specification.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION

Figure 1:
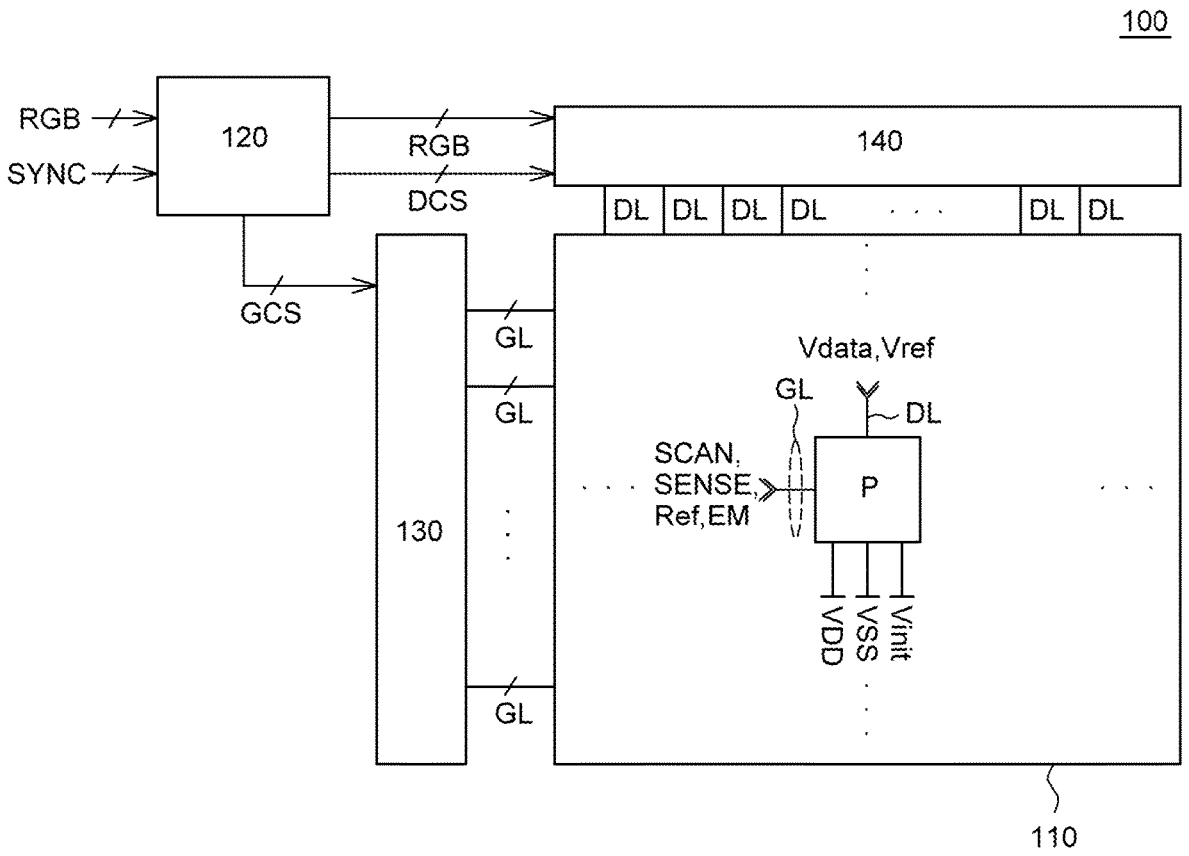
FIG. 1 is a schematic block diagram for explaining an organic light emitting display device according to an exemplary aspect of the present disclosure.

Advantages and characteristics of the present disclosure and a method of achieving the advantages and characteristics will be clear by referring to exemplary aspects described below in detail together with the accompanying drawings. However, the present disclosure is not limited to the exemplary aspects disclosed herein but will be implemented in various forms. The exemplary aspects are provided by way of example only so that those skilled in the art can fully understand the disclosures of the present disclosure and the scope of the present disclosure. Therefore, the present disclosure will be defined only by the scope of the appended claims.

The shapes, sizes, ratios, angles, numbers, and the like illustrated in the accompanying drawings for describing the exemplary aspects of the present disclosure are merely examples, and the present disclosure is not limited thereto. Like reference numerals generally denote like elements throughout the specification. Further, in the following description of the present disclosure, a detailed explanation of known related technologies may be omitted to avoid unnecessarily obscuring the subject matter of the present disclosure. The terms such as "including," "having," and "consist of" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or more parts may be positioned between the two parts unless the terms are used with the term "immediately" or "directly".

When an element or layer is disposed "on" another element or layer, another layer or another element may be interposed directly on the other element or therebetween.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Like reference numerals generally denote like elements throughout the specification.

A size and a thickness of each component illustrated in the drawing are illustrated for convenience of description, and the present disclosure is not limited to the size and the thickness of the component illustrated.

The features of various aspects of the present disclosure can be partially or entirely adhered to or combined with each other and can be interlocked and operated in technically various ways, and the aspects can be carried out independently of or in association with each other.

Hereinafter, a display device according to exemplary aspects of the present disclosure will be described in detail with reference to accompanying drawings.

In the present disclosure, a TFT may be configured to be a P type or an N type and in the following description, the TFT will be described as an N type TFT for the convenience of description. Further, when a pulsed signal is described, a gate high voltage (VGH) state is defined as a "high state" and a gate low voltage (VGL) state is defined as a "low state".

FIG. 1 is a schematic block diagram for explaining an organic light emitting display device according to an exemplary aspect of the present disclosure.

Referring to FIG. 1, an organic light emitting display device 100 includes a display panel 110 including a plurality of pixels P connected to gate lines GL and data lines DL, a gate driver 130 which supplies gate signals to the gate lines GL, a data driver 140 which supplies data voltages to the data lines DL, and a timing controller 120 which controls the gate driver 130 and the data driver 140.

The timing controller 120 processes image data RGB input from the outside suitable for a size and a resolution of the display panel 110 to supply the processed image data to the data driver 140. Further, the timing controller 120 generates a plurality of gate and data control signals GCS and DCS using synchronization signals input from the outside, for example, a dot clock signal DCLK, a data enable signal DE, a horizontal synchronization signal Hsync, and a vertical synchronization signal Vsync. The plurality of generated gate and data signals GCS and DCS is supplied to the gate driver 130 and the data driver 140, respectively, to control the gate driver 130 and the data driver 140.

The gate driver 130 supplies the gate signals to the gate lines GL in accordance with the gate control signal GCS supplied from the timing controller 120. Here, the gate signal includes at least one of a scan signal SCAN, a reference signal Ref, a sensing signal SENSE, and an emission control signal EM(n). Even though in FIG. 1, it is illustrated that the gate driver 130 is disposed to be spaced apart from one side of the display panel 110, the number of the gate drivers 130 and an arrangement position thereof are not limited thereto. That is, the gate driver 130 may be disposed at one side or both sides of the display panel 110 in a gate in panel (GIP) manner.

The data driver 140 converts image data RGB into a data voltage Vdata in accordance with the data control signal DCS supplied from the timing controller 120 and supplies the converted data voltage Vdata to the pixel P through the data lines DL.

In the display panel 110, the plurality of gate lines GL and the plurality of data lines DL intersect each other and the plurality of pixels P is connected to the gate lines GL and the data lines DL, respectively.

Here, one pixel P is supplied with a gate signal from the gate driver 130 through the gate line GL, is supplied with a data voltage from the data driver 140 through the data line DL, and is supplied with various powers through a power supply line.

Specifically, one pixel P receives at least one of the scan signal SCAN, the reference signal Ref, the sensing signal SENSE, and the emission control signal EM(n) through the gate line GL. One pixel P receives the data voltage Vdata through the data line DL, receives the reference voltage Vref through a reference voltage line, and receives a high potential voltage VDD, a low potential voltage VSS, and an initialization voltage Vinit through the power supply line.

Further, each pixel P includes an organic light emitting diode OD and a pixel circuit which controls the driving of the organic light emitting diode OD. Here, the organic light emitting diode OD is configured by an anode, a cathode, and an organic light emitting layer between the anode and the cathode. The pixel circuit includes a switching TFT, a driving TFT, and a capacitor. Specifically, in the pixel circuit, the driving TFT controls a current amount supplied to the organic light emitting diode OD in accordance with the data voltage Vdata charged in the capacitor to adjust an emission amount of the organic light emitting diode OD. The switching TFT receives the scan signal SCAN supplied through the gate line GL to charge the data voltage Vdata to the capacitor.

As described above, the organic light emitting display device 100 includes a driving TFT and a switching TFT in the pixel circuit and active layers which configure the driving TFT and the switching TFT may be configured by different materials. As described above, the driving TFT and the switching TFT in one pixel circuit are formed of TFTs having different properties so that the organic light emitting display device 100 may include multi-type TFTs.

Specifically, in the organic light emitting display device 100 including the multi-type TFT, an LTPS TFT using a low temperature poly-silicon (hereinafter, abbreviated as an LTPS) is used as a TFT in which a polycrystalline semiconductor material is used for an active layer. Since the polysilicon material has a high mobility (100 $cm^2/Vs$ or higher), an energy power consumption is low and a reliability is high, so that the polysilicon material may be applied to a gate driver 130 for a driving element which drives TFTs for a display element and/or a multiplexer MUX. Alternatively, the polysilicon material may be applied for a driving TFT in the pixel P in the organic light emitting display device 100.

Further, in the organic light emitting display device 100 including a multi-type TFT, an oxide semiconductor TFT having an oxide semiconductor material which is used for an active layer is used. The oxide semiconductor material has a low off-current so that the oxide semiconductor material is appropriate for a switching TFT having a short turn-on time and a long turn-off time.

Specifically, the organic light emitting display device 100 including a multi-type TFT according to the exemplary aspect of the present disclosure includes a pixel circuit in which a switching TFT is formed of an oxide semiconductor TFT and a driving TFT is formed of an LTPS TFT. However, in the organic light emitting display device 100 of the present disclosure, the switching TFT is not limited to the oxide semiconductor TFT and the driving TFT is not limited to the LTPS TFT, but various multi-type TFTs may be configured. Further, in the organic light emitting display device 100 of the present disclosure, the pixel circuit does not include a multi-type TFT, but may include a one-type TFT.

Hereinafter, a structure of the circuit and an operation thereof when the organic light emitting display device according to the exemplary aspect of the present disclosure is a 5T1C pixel circuit will be described in detail.

Figure 2:
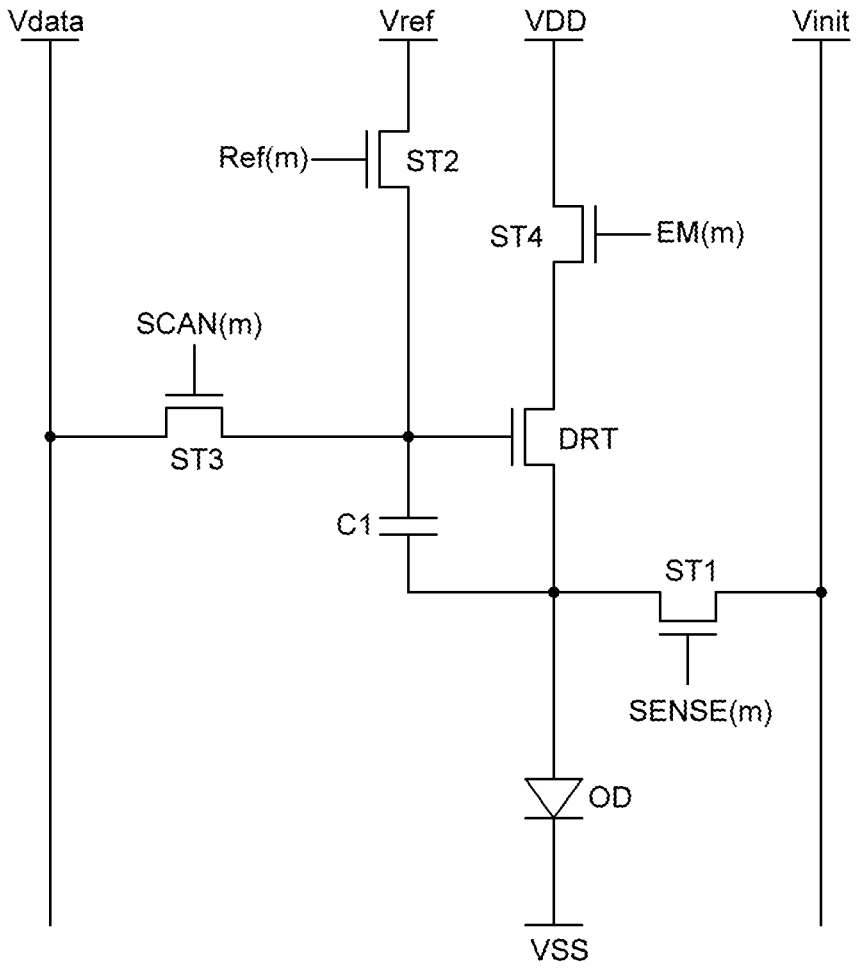
FIG. 2 is a circuit diagram illustrating a 5T1C pixel circuit equipped in an organic light emitting display device according to an exemplary aspect of the present disclosure.

FIG. 2 is a circuit diagram illustrating a 5T1C pixel circuit equipped in an organic light emitting display device according to an exemplary aspect of the present disclosure.

Referring to FIG. 2, the pixel circuit includes a driving TFT DRT, four switching TFTs ST1, ST2, ST3, and ST4, and one capacitor C1.

The driving TFT DRT includes a gate node connected to a second switching TFT ST2 and a third switching TFT ST3, a source node connected to a first switching TFT ST1, and a drain node connected to a fourth switching TFT ST4.

Specifically, the gate node of the driving TFT DRT is electrically connected to the data line through which the data voltage Vdata is supplied and a reference voltage line through which the reference voltage Vref is supplied. Therefore, the gate node of the driving TFT DRT is connected to a source node of the third switching TFT ST3 to be supplied with the data voltage Vdata and is connected to a source node of the second switching TFT ST2 to be supplied with the reference voltage Vref. The drain node of the driving TFT DRT is electrically connected to a high potential voltage (VDD) line. Therefore, the drain node of the driving TFT DRT is connected to a source node of the fourth switching TFT ST4 to be supplied with the high potential voltage VDD. The source node of the driving TFT DRT is electrically connected to the organic light emitting diode OD. Specifically, the source node of the driving TFT DRT is connected to an anode of the organic light emitting diode OD and the source node of the first switching TFT ST1.

Therefore, when the fourth switching TFT ST4 is turned on and the driving TFT DRT is also turned on by the emission control signal EM(m), the driving TFT DRT controls a magnitude of the current flowing into the organic light emitting diode OD based on the voltage which is applied to the gate node and the source node to control the luminance of the organic light emitting diode OD.

The first switching TFT ST1 includes a gate node connected to the sensing signal SENSE(m) line, a drain node connected to an initialization voltage Vinit line, and a source node connected to the source node of the driving TFT DRT. Specifically, when the sensing signal SENSE(m) which is applied to the gate node of the first switching TFT ST1 is high, the first switching TFT ST1 is turned on. The first switching TFT ST1 supplies the initialization voltage Vinit to the source node of the driving TFT DRT.

Therefore, when the sensing signal SENSE(m) is high, the first switching TFT ST1 is turned on to supply the initialization voltage Vinit to the source node of the driving TFT DRT to initialize the data voltage Vdata written in the organic light emitting diode OD.

The second switching TFT ST2 includes a gate node connected to the reference signal Ref(m) line, a drain node connected to a reference voltage line through which the reference voltage Vref is applied, and a source node connected to the driving TFT DRT. Specifically, the gate node of the second switching TFT ST2 is connected to the reference signal Ref(m) line so that the second switching TFT ST2 is turned on or turned off by the reference signal Ref(m). The drain node of the second switching TFT ST2 is connected to the reference voltage line to transmit the reference voltage Vref to the gate node of the driving TFT DRT.

Therefore, when the reference signal Ref(m) is high, the second switching TFT ST2 is turned on to supply the reference voltage Vref to the gate node of the driving TFT DRT.

The third switching TFT ST3 includes a gate node connected to the scan signal SCAN(m) line, a drain node connected to the data line, and a source node connected to the driving TFT DRT. Specifically, the gate node of the third switching TFT ST3 is connected to the scan signal SCAN (m) line so that the third switching TFT ST3 is turned on or turned off by the scan signal SCAN(m). The drain node of the third switching TFT ST3 is connected to the data line to transmit the data voltage Vdata to the gate node of the driving TFT DRT.

Therefore, when the scan signal SCAN(m) is high, the third switching TFT ST3 is turned on to supply the data voltage Vdata to the gate node of the driving TFT DRT.

The fourth switching TFT ST4 includes a gate node connected to the emission control signal EM(m) line, a drain node connected to the high potential voltage VDD line, and a source node connected to the drain node of the driving TFT DRT. Specifically, the gate node of the fourth switching TFT ST4 is connected to the emission control signal EM(m) line so that when the emission control signal EM(m) is high, the fourth switching TFT ST4 is turned on.

Therefore, when the emission control signal EM(m) is high, the fourth switching TFT ST4 is turned on to supply the high potential voltage VDD to the drain node of the driving TFT DRT so that the driving TFT DRT controls the current amount of the organic light emitting diode OD by the data voltage Vdata.

The capacitor C1 is a storage capacitor which stores a voltage applied to the gate node and the source node of the driving TFT DRT.

Specifically, the capacity C1 is electrically connected to the gate node of the driving TFT DRT and the source node of the driving TFT DRT. Therefore, the capacitor C1 stores a voltage corresponding to a difference of voltages applied to the gate node and the source node of the driving TFT DRT.

For example, the first capacitor C1 stores and samples the voltage difference of the gate node and the source node of the driving TFT DRT as a threshold voltage of the driving TFT DRT. Further, when the data voltage Vdata is applied, the first capacitor C1 stores the data voltage Vdata to perform programming. That is, the first capacitor C1 samples the threshold voltage of the driving TFT DRT by a source-follower manner. The sampling and programming of the capacitor C1 will be described below with reference to FIG. 3.

Figure 3:
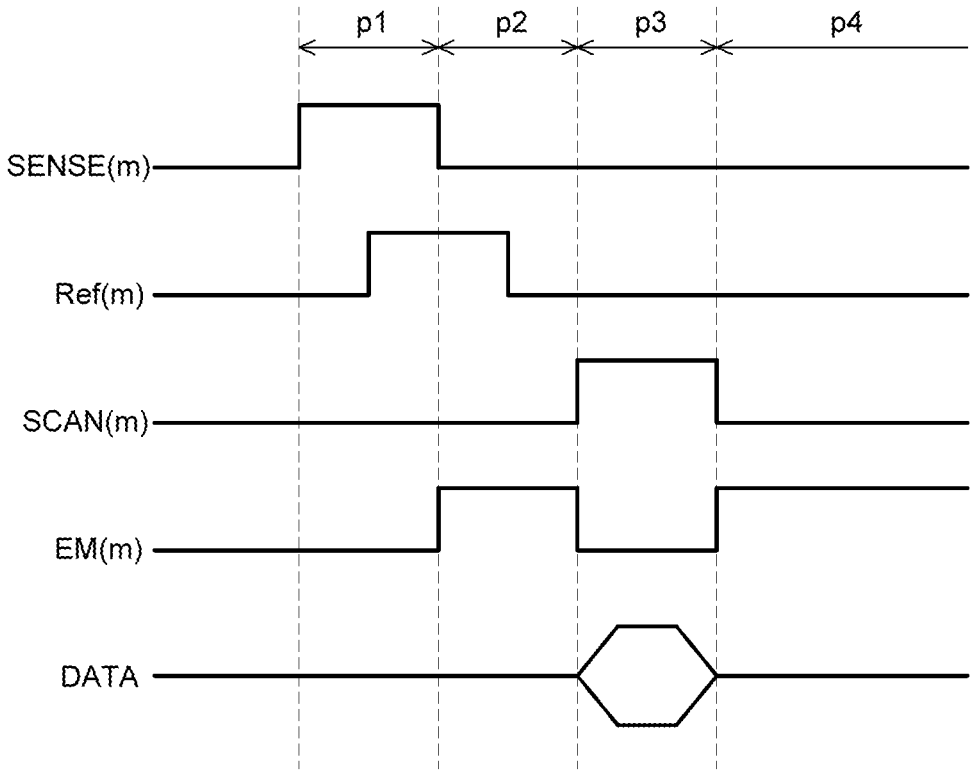
FIG. 3 is a waveform illustrating a signal input to a pixel circuit illustrated in FIG. 2.

FIG. 3 is a waveform illustrating a signal input to a pixel circuit illustrated in FIG. 2. For the convenience of description, description will be made below with reference to FIG. 2.

Referring to FIG. 3, the organic light emitting diode OD emits light through an initialization period p1, a sampling period p2, a programming period p3, and an emission period p4. Even though it is illustrated that the initialization period p1, the sampling period p2, and the programming period p3 are maintained, respectively, for the same time, times of the initialization period p1, the sampling period p2, and the programming period p3 may vary in various ways according to the aspect.

First, at a moment when the initialization period p1 starts, the sensing signal SENSE(m) rises to be a high state. Thereafter, the reference signal Ref(m) rises to be a high state. Further, during the initialization period p1, the emission control signal EM(m) and the scan signal SCAN(m) are in a low state.

Therefore, during the initialization period p1, the first switching TFT ST1 and the second switching TFT ST2 are sequentially turned on and the third switching TFT ST3 and the fourth switching TFT ST4 are turned off.

Therefore, after the initialization voltage Vinit is supplied from the initialization voltage Vinit line to the source node of the driving TFT DRT by the first switching TFT ST1, the reference voltage Vref is supplied from the reference voltage line to the gate node of the driving TFT DRT by the second switching TFT ST2. That is, as the initialization voltage Vinit is supplied to the source node of the driving TFT DRT, the data voltage Vdata written in the organic light emitting diode OD is initialized.

At a moment when the sampling period p2 starts, the sensing signal SENSE(m) falls to be a low state and the emission control signal EM(m) rises to be a high state. Thereafter, the reference signal Ref(m) falls to be a low state. The scan signal SCAN(m) is in a low state during the sampling period p2.

Therefore, during the sampling period p2, the fourth switching TFT ST4 is turned on and the first switching TFT ST1 is turned off. Thereafter, the second switching TFT ST2 is turned off. Therefore, the reference voltage Vref is supplied to the gate node of the driving TFT DRT through the second switching TFT ST2 and the high potential voltage VDD is supplied to the drain node of the driving TFT DRT through the turned-on fourth switching TFT ST4. That is, the voltage of the gate node of the driving TFT DRT is maintained to be a reference voltage Vref during the sampling period p2 and the voltage of the source node of the driving TFT DRT rises by a drain-source current (hereinafter, referred to as Ids) of the driving TFT DRT. Here, the gate-source voltage (hereinafter, referred to as Vgs) of the driving TFT DRT is sampled as the threshold voltage of the driving TFT DRT by the source-follower manner. The threshold voltage of the driving TFT DRT sampled as described above is stored in the capacitor C1. Therefore, during the sampling period p2, the voltage of the gate node of the driving TFT DRT is the reference voltage Vref and the voltage of the source node of the driving TFT DRT is Vref−Vth.

At a moment when the programming period p3 starts, the scan signal SCAN(m) rises to be a high state and the emission control signal EM(m) falls to be a low state. Further, the sensing signal SENSE(m) and the reference signal Ref(m) are maintained to be a low state.

Therefore, during the programming period p3, only the third switching TFT ST3 is turned on and the first switching TFT ST1, the second switching TFT ST2, and the fourth switching TFT ST4 are turned off. Accordingly, the data voltage Vdata is supplied to the gate node of the driving TFT DRT through the turned-on third switching TFT ST3 and the drain node and the source node of the driving TFT DRT are floated.

During the programming period p3, the data voltage Vdata is supplied to the gate node of the driving TFT DRT. Specifically, a voltage change amount of the gate node of the driving TFT DRT is Vdata-Vref and during the programming period p3, the voltage change amount in the source node of the driving TFT DRT is a×(Vdata−Vref). Here, a is determined by the coupling of the capacitor C1. That is, the voltage of the source node of the driving TFT DRT has a value obtained by adding the voltage change amount a×(Vdata−Vref) in the source node of the driving TFT DRT during the programming period p3 to Vref−Vth determined in the sampling period p2. In other words, during the programming period p3, the voltage of the source node of the driving TFT DRT is (Vref−Vth)+a×(Vdata−Vref) and Vgs of the driving TFT DRT is programmed to be ((1−a)×(Vdata−Vref)+Vth).

At a moment when the emission period p4 starts, the scan signal SCAN(m) falls to be a low state and the emission control signal EM(m) rises to be a high state. Further, the sensing signal SENSE(m) and the reference signal Ref(m) are maintained to be a low state.

Therefore, during the emission period p4, the first switching TFT ST1, the second switching TFT ST2, and the third switching TFT ST3 are turned off and the fourth switching TFT ST4 is turned on. Accordingly, the high potential voltage VDD is supplied to the drain node of the driving TFT DRT through the turned-on fourth switching TFT ST4 and a relationship of Vds>Vgs>Vth is satisfied so that the current flows into the organic light emitting diode OD through the driving TFT DRT. Specifically, during the emission period p4, the current holed flowing into the organic light emitting diode OD is adjusted by Vgs of the driving TFT DRT and the organic light emitting diode OD emits light by the current holed so that luminance is increased. As described above, the current holed flowing into the organic light emitting diode OD during the emission period p4 will be represented by Equation 1.

$$Ioled = \frac{k}{2}[(1-a)\times(Vdata-Vref)]^2 \quad \text{[Equation 1]}$$

Here, k is a proportional constant to which various factors of the pixel circuit are reflected. Referring to Equation 1, Vth is erased from Equation 1 so that the current holed flowing into the organic light emitting diode OD is not affected by the threshold voltage of the driving TFT DRT.

Hereinafter, a gate driver of an organic light emitting display device according to an exemplary aspect of the present disclosure will be described in detail with reference to FIGS. 4 to 6.

Figure 4:
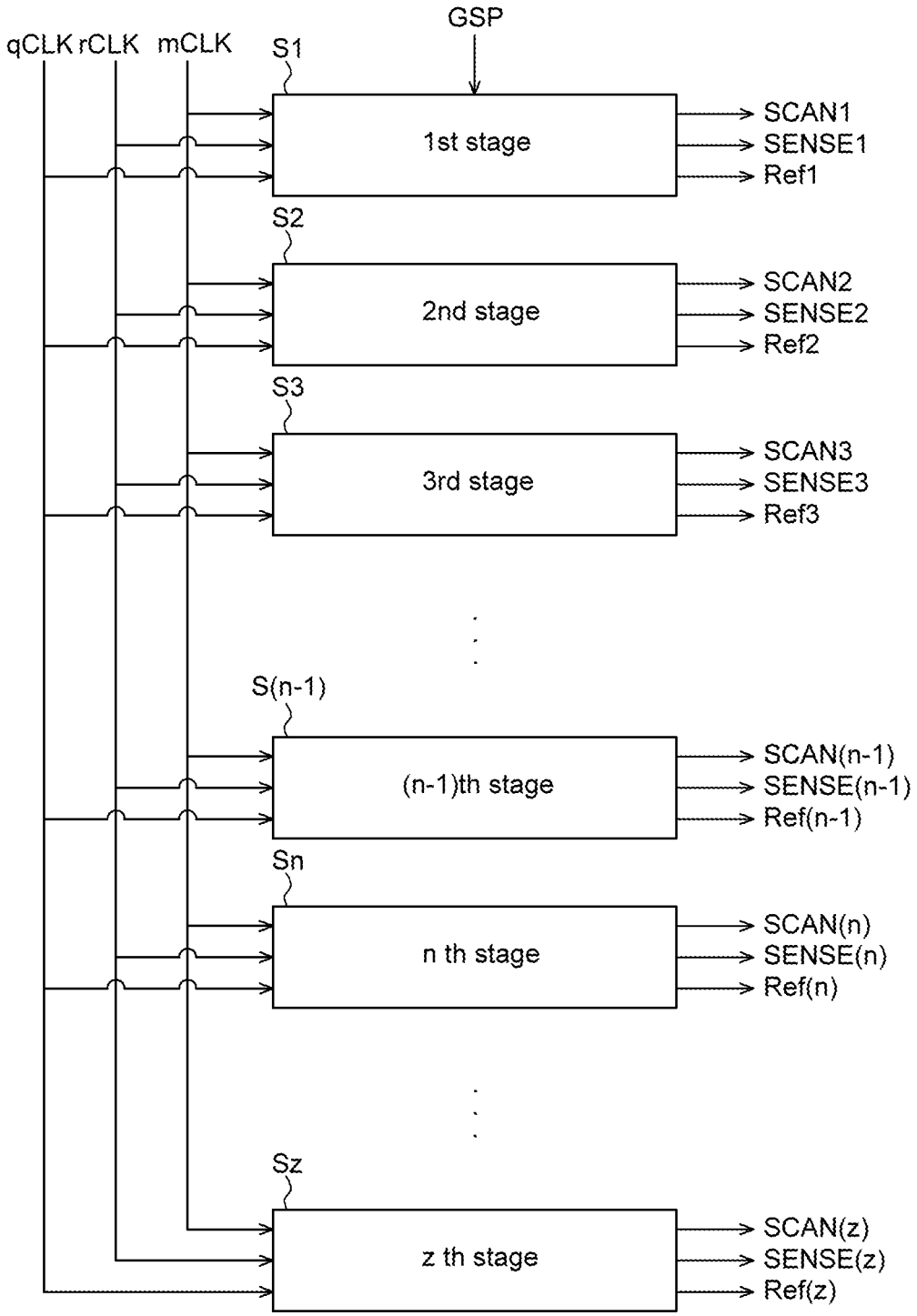
FIG. 4 is a block diagram illustrating a gate driver of a display device according to an exemplary aspect of the present disclosure.

FIG. 4 is a block diagram illustrating a gate driver of a display device according to an exemplary aspect of the present disclosure.

As illustrated in FIG. 4, the gate driver 130 includes a first to z-th stages S1 to Sz which sequentially output gate signals such as a scan signal SCAN, a reference signal Ref, and a sensing signal SENSE, in response to first to third clock signals mCLK, rCLK, and qCLK supplied from the timing controller 120 and a gate start pulse GSP among gate control signals GCSs.

That is, each of the first to z-th stages S1 to Sz outputs the first to third clock signals mCLK, rCLK, and qCLK as the scan signal SCAN, the reference signal Ref, and the sensing signal SENSE which are gate signals, in accordance with carry signals CARRY(n−p) (p is a natural number) of a previous stage and carry signals CARRY(n+q) (q is a natural number) of a subsequent stage.

Here, the first to third clock signals mCLK, rCLK, and qCLK may be cyclic clock signals in which a pulse width and a phase vary in accordance with the scan signal SCAN, the reference signal Ref, and the sensing signal SENSE which are output to the pixel circuit.

Specifically, the first stage S1 is set by being applied with the gate start pulse GSP and outputs the first to third clock signals mCLK, rCLK, and qCLK as a first scan signal SCAN1, a first reference signal Ref1, a first sensing signal SENSE1 which are gate signals and a first carry signal CARRY1. The first stage S1 is reset by being applied with a carry signal CARRY(1+q) of the subsequent stage.

A second stage S2 is set by being applied with the carry signal CARRY(2−p) of the previous stage or the gate start pulse GSP and outputs the first to third clock signals mCLK, rCLK, and qCLK as a second scan signal SCAN2, a second reference signal Ref2, and a second sensing signal SENSE2 which are gate signals and a second carry signal CARRY2. The second stage S2 is reset by being applied with a carry signal CARRY(2+q) of the subsequent stage.

An (n) th stage Sn is set by being applied with the carry signal CARRY(n−p) of the previous stage or the gate start pulse GSP and outputs the first to third clock signals mCLK, rCLK, and qCLK as an (n) th scan signal SCAN(n), an (n) th reference signal Ref(n), an (n) th sensing signal SENSE (n) which are gate signals and an (n) th carry signal CARRY(n). The (n) th stage Sn is reset by being applied with a carry signal CARRY(n+q) of the subsequent stage or a gate reset pulse (not illustrated).

Figure 5:
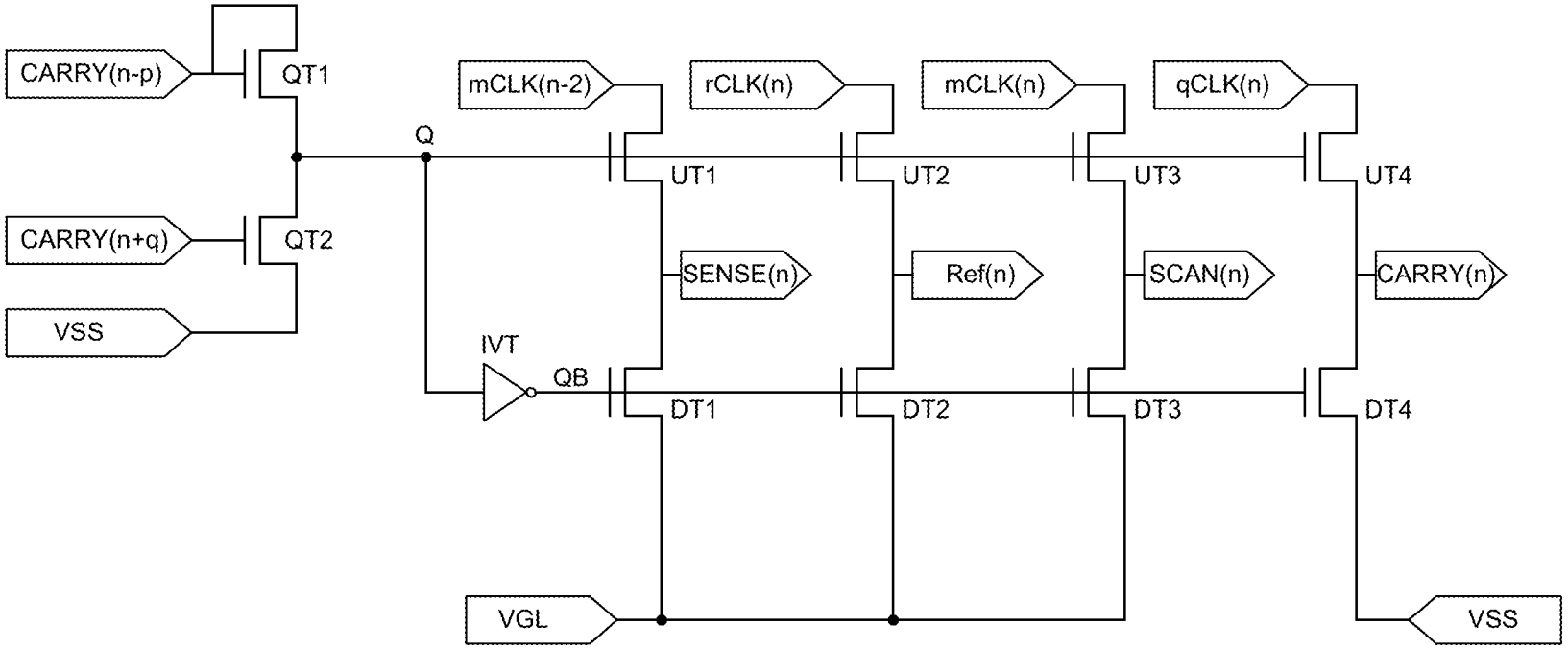
FIG. 5 is a view illustrating an equivalent circuit of each stage equipped in a gate driver of an organic light emitting display device according to an exemplary aspect of the present disclosure.

FIG. 5 is a view illustrating an equivalent circuit of each stage equipped in a gate driver of an organic light emitting display device according to an exemplary aspect of the present disclosure.

Hereinafter, a circuit configuration of each stage S1 to Sz and a process of outputting the gate signal by each stage S1 to Sz will be described with the (n) th stage Sn as an example.

As illustrated in FIG. 5, the (n) th stage includes not only a first output unit which outputs a sensing signal SENSE(n), a second output unit which outputs a reference signal Ref(n), a third output unit which outputs a scan signal SCAN(n), and a fourth output unit which outputs a carry signal CARRY(n), by a voltage of a Q node Q and a voltage of a QB node QB, but also a first controller which controls the Q node Q and a second controller which controls the QB node QB.

That is, all the first to fourth output units of the organic light emitting display device according to an exemplary aspect of the present disclosure are multi-output units which are controlled by the voltage of the Q node Q and the voltage of the QB node QB.

The first output unit includes a first pull-up TFT UT1 which pulls up the sensing signal SENSE(n) and a first pull-down TFT DT1 which pulls down the sensing signal SENSE(n).

Here, the first pull-up TFT UT1 is a pull-up TFT in which the Q node Q is connected to a gate, an (n−2) th phase first clock signal mCLK(n−2) which is an input is applied to a drain, and a sensing signal SENSE(n) line which is an output terminal is connected to a source. When the voltage of the Q node Q is high, the first pull-up TFT UT1 is turned on to output the (n−2) th phase first clock signal mCLK(n−2) as a sensing signal SENSE(n).

The first pull-down TFT DT1 is a pull-down TFT in which a QB node QB is connected to a gate, a low potential voltage VGL which is an input is applied to a drain, and a sensing signal SENSE(n) line which is an output terminal is connected to a source. When the voltage of the QB node QB is high, the first pull-down TFT DT1 is turned on to output the low potential voltage VGL as a sensing signal SENSE(n).

The second output unit includes a second pull-up TFT UT2 which pulls up the reference signal Ref(n) and a second pull-down TFT DT2 which pulls down the reference signal Ref(n).

Here, the second pull-up TFT UT2 is a pull-up TFT in which the Q node Q is connected to a gate, an (n) th phase second clock signal rCLK(n) which is an input is applied to a drain, and a reference signal Ref(n) line which is an output terminal is connected to a source. When the voltage of the Q node Q is high, the second pull-up TFT UT2 is turned on to output the (n) th phase second clock signal rCLK(n) as a reference signal Ref(n).

The second pull-down TFT DT2 is a pull-down TFT in which a QB node QB is connected to a gate, a low potential voltage VGL which is an input is applied to a drain, and a reference signal Ref(n) line which is an output terminal is connected to a source. When the voltage of the QB node QB is high, the second pull-down TFT DT2 is turned on to output the low potential voltage VGL as a reference signal Ref(n).

The third output unit includes a third pull-up TFT UT3 which pulls up the scan signal SCAN(n) and a third pull-down TFT DT3 which pulls down the scan signal SCAN(n).

Here, the third pull-up TFT UT3 is a pull-up TFT in which the Q node Q is connected to a gate, an (n) th phase first clock signal mCLK(n) which is an input is applied to a drain, and a scan signal SCAN(n) line which is an output terminal is connected to a source. When the voltage of the Q node Q is high, the third pull-up TFT UT3 is turned on to output the (n) th phase first clock signal rCLK(n) as a scan signal SCAN(n).

The third pull-down TFT DT3 is a pull-down TFT in which the QB node QB is connected to a gate, a low potential voltage VGL which is an input is applied to a drain, and a scan signal SCAN(n) line which is an output terminal is connected to a source. When the voltage of the QB node QB is high, the third pull-down TFT DT3 is turned on to output the low potential voltage VGL as a scan signal SCAN(n).

The fourth output unit includes a fourth pull-up TFT UT4 which pulls up the carry signal CARRY(n) and a fourth pull-down TFT DT4 which pulls down the carry signal CARRY(n).

Here, the fourth pull-up TFT UT4 is a pull-up TFT in which the Q node Q is connected to a gate, an (n) th phase third clock signal qCLK(n) which is an input is applied to a drain, and a carry signal CARRY(n) line which is an output terminal is connected to a source. When the voltage of the Q node Q is high, the fourth pull-up TFT UT4 is turned on to output the (n) th phase third clock signal qCLK(n) as a reference signal Ref(n).

The fourth pull-down TFT DT4 is a pull-down TFT in which the QB node QB is connected to a gate, a low potential driving voltage VSS which is an input is applied to a drain, and the carry signal CARRY(n) line which is an output terminal is connected to a source. When the voltage of the QB node QB is high, the fourth pull-down TFT DT4 is turned on to output the low potential driving voltage VSS as a carry signal CARRY(n).

The first controller is applied with a carry signal CARRY (n−p) of the previous stage and a carry signal CARRY(n+q) of the subsequent stage to control a voltage which is applied to the Q node Q and includes a first QTFT QT1 and a second QTFT QT2.

The first QTFT QT1 is a TFT in which the carry signal CARRY(n−p) of the previous stage is applied to a gate and a drain and a Q node Q is connected to a source. When the carry signal CARRY(n−p) of the previous stage is high, the first QTFT QT1 is turned on to output a high potential driving voltage which is the high carry signal CARRY(n−p) of the previous stage to the Q node Q.

The second QTFT QT2 is a TFT in which the carry signal CARRY(n+q) of the subsequent stage is applied to a gate, a low potential driving voltage VSS which is an input is applied to a drain, and a Q node Q is connected to a source. When the carry signal CARRY(n+q) of the subsequent stage is high, the second QTFT QT2 is turned on to output the low potential driving voltage VSS to the Q node Q.

The second controller may be configured by an inverter IVT in which the above-described Q node Q is connected to an input terminal and the QB node QB is connected to an output terminal. Therefore, an inversed voltage state to that of the Q node Q may be maintained in the QB node by the second controller.

Figure 6:
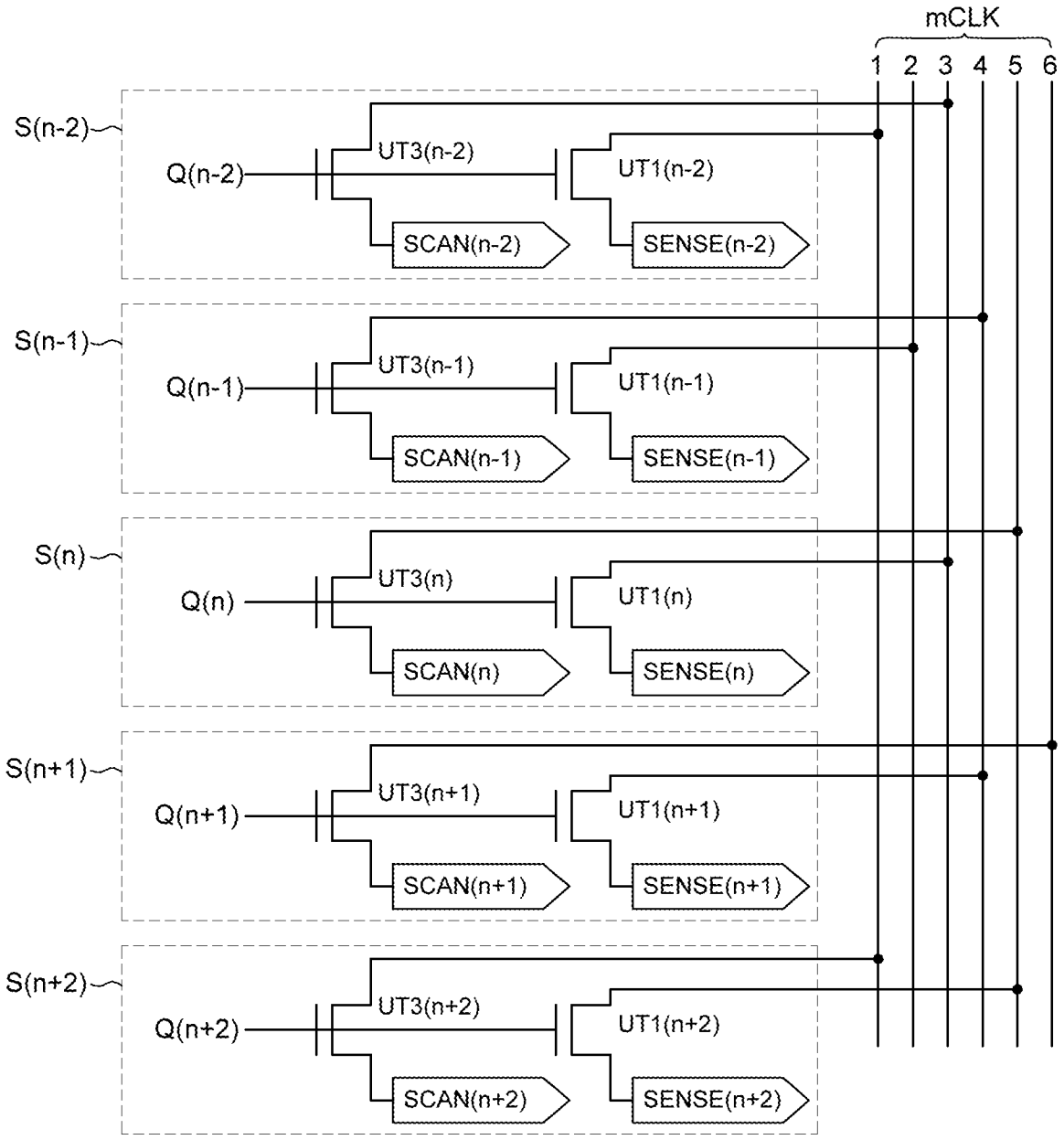
FIG. 6 is a block diagram illustrating a gate driver of a display device according to an exemplary aspect of the present disclosure.

FIG. 6 is a block diagram illustrating a gate driver of a display device according to an exemplary aspect of the present disclosure.

For the convenience of description, in FIG. 6, only a connection relationship of the first pull-up TFT UT1 and the third pull-up TFT UT3 of the (n−2) th stage S(n−2) to n+2-th stage S(n+2) and the first clock signal mCLK line is illustrated.

That is, first clock signals mCLK having different phases from each other are applied to the first pull-up TFT UT1 of the first output unit and the third pull-up TFT UT3 of the third output unit.

A difference between a phase of the first clock signal mCLK applied to the first pull-up TFT UT1 and a phase of the first clock signal mCLK applied to the third pull-up TFT UT3 is determined by a difference of times when the scan signal SCAN(n) and the sensing signal SENSE(n) are applied to the above-described pixel circuit.

As illustrated in FIG. 6, an (n−2) th phase first clock signal mCLK(n−2) is applied to the first pull-up TFT UT1 of the first output unit and an (n) th phase first clock signal mCLK(n) is applied to the third pull-up TFT UT3 of the third output unit.

Specifically, when the first clock signal mCLK is a 6th phase clock signal, in the (n−2) th stage S(n−2), a first phase first clock signal mCLK1 is applied to the first pull-up TFT UT1(*n*−2) and a third phase first clock signal mCLK3 is applied to the third pull-up TFT UT3(*n*−2). In the (n−1) th stage S(n−1), a second phase first clock signal mCLK2 is applied to the first pull-up TFT UT1(*n*−1) and a fourth phase first clock signal mCLK4 is applied to the third pull-up TFT UT3(*n*−1). In the (n) th stage S(n), a third phase first clock signal mCLK3 is applied to the first pull-up TFT UT1(*n*) and a fifth phase first clock signal mCLK5 is applied to the third pull-up TFT UT3(*n*). In the n+l-th stage, the fourth phase first clock signal mCLK4 is applied to the first pull-up TFT UT1(*n*+1) and a sixth phase first clock signal mCLK6 is applied to the third pull-up TFT UT3(*n*+1). In the n+2-th stage, the fifth phase first clock signal mCLK5 is applied to the first pull-up TFT UT1(*n*+2) and the first phase first clock signal mCLK1 is applied to the third pull-up TFT UT3(*n*+2).

That is, the first pull-up TFT UT1(*n*) of the (n) th stage and the third pull-up TFT UT3(*n*−2) of the (n−2) th stage may share the same phase clock signal.

As described above, the clock signals are shared in the gate driver to output the plurality of scan signals and sensing signals. Therefore, a gate driver embedded in the display panel is simplified so that a bezel size is reduced and outputs of the scan signal and the sensing signal are maintained to be separated in the gate driver so that an output load is reduced, thereby suppressing the delay of the gate signal.

Hereinafter, a circuit configuration of each stage S1 to Sz disposed in the gate driver of the organic light emitting display device according to another exemplary aspect of the present disclosure and a process of outputting the gate signal by each stage S1 to Sz will be described with the (n) th stage Sn as an example, with reference to FIGS. 7 and 8.

Figure 7:
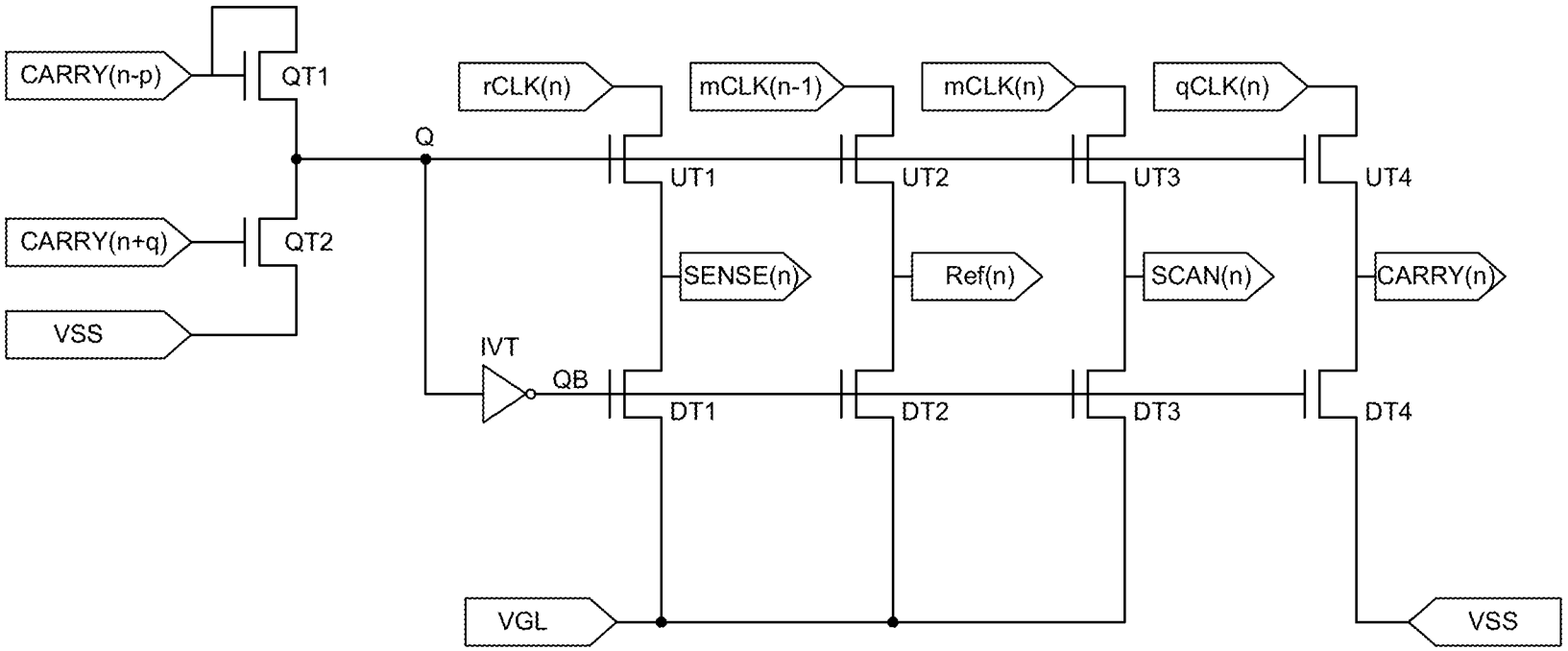
FIG. 7 is a view illustrating an equivalent circuit of each stage equipped in a gate driver of an organic light emitting display device according to another exemplary aspect of the present disclosure.

FIG. 7 is a view illustrating an equivalent circuit of each stage equipped in a gate driver of an organic light emitting display device according to another exemplary aspect of the present disclosure.

As illustrated in FIG. 7, the (n) th stage includes a first output unit which outputs a sensing signal SENSE(n), a second output unit which outputs a reference signal Ref(n), a third output unit which outputs a scan signal SCAN(n), and a fourth output unit which outputs a carry signal CARRY(n), by a voltage of a Q node Q and a voltage of a QB node QB and also includes a first controller which controls the Q node Q and a second controller which controls the QB node QB.

That is, all the first to fourth output units of the organic light emitting display device according to an exemplary aspect of the present disclosure are multi-output units which are controlled by the voltage of the Q node Q and the voltage of the QB node QB.

The first output unit includes a first pull-up TFT UT1 which pulls up the sensing signal SENSE(n) and a first pull-down TFT DT1 which pulls down the sensing signal SENSE(n).

Here, the first pull-up TFT UT1 is a pull-up TFT in which the Q node Q is connected to a gate, an (n) th phase second clock signal rCLK(n) which is an input is applied to a drain, and a sensing signal SENSE(n) line which is an output terminal is connected to a source. When the voltage of the Q node Q is high, the first pull-up TFT UT1 is turned on to output the (n) th phase second clock signal rCLK(n) as a sensing signal SENSE(n).

The first pull-down TFT DT1 is a pull-down TFT in which the QB node QB is connected to a gate, a low potential voltage VGL which is an input is applied to a drain, and a sensing signal SENSE(n) line which is an output terminal is connected to a source. When the voltage of the QB node QB is high, the first pull-down TFT DT1 is turned on to output the low potential voltage VGL as a sensing signal SENSE (n).

The second output unit includes a second pull-up TFT UT1 UT2 which pulls up the reference signal Ref(n) and a second pull-down TFT DT2 which pulls down the reference signal Ref(n).

Here, the second pull-up TFT UT2 is a pull-up TFT in which the Q node Q is connected to a gate, an (n−1) th phase first clock signal mCLK(n−1) which is an input is applied to a drain, and a reference signal Ref(n) line which is an output terminal is connected to a source. When the voltage of the Q node Q is high, the second pull-up TFT UT2 is turned on to output the (n−1) th phase first clock signal mCLK(n−1) as a reference signal Ref(n).

The second pull-down TFT DT2 is a pull-down TFT in which the QB node QB is connected to a gate, a low potential voltage VGL which is an input is applied to a drain, and a reference signal Ref(n) line which is an output terminal is connected to a source. When the voltage of the QB node QB is high, the second pull-down TFT DT2 is turned on to output the low potential voltage VGL as a reference signal Ref(n).

The third output unit includes a third pull-up TFT UT3 which pulls up the scan signal SCAN(n) and a third pull-down TFT DT3 which pulls down the scan signal SCAN(n).

Here, the third pull-up TFT UT3 is a pull-up TFT in which the Q node Q is connected to a gate, an (n) th phase first clock signal mCLK(n) which is an input is applied to a drain, and a scan signal SCAN(n) line which is an output terminal is connected to a source. When the voltage of the Q node Q is high, the third pull-up TFT UT3 is turned on to output the (n) th phase first clock signal rCLK(n) as a scan signal SCAN(n).

The third pull-down transistor DT3 is a pull-down transistor in which the QB node QB is connected to a gate, a low potential voltage VGL which is an input is applied to a drain, and a scan signal SCAN(n) line which is an output terminal is connected to a source. When the voltage of the QB node QB is high, the third pull-down TFT DT3 is turned on to output the low potential voltage VGL as a scan signal SCAN(n).

The fourth output unit includes a fourth pull-up TFT UT4 which pulls up the carry signal CARRY(n) and a fourth pull-down TFT DT4 which pulls down the carry signal CARRY(n).

Here, the fourth pull-up TFT UT4 is a pull-up TFT in which the Q node Q is connected to a gate, an (n) th phase third clock signal qCLK(n) which is an input is applied to a drain, and a carry signal CARRY(n) line which is an output terminal is connected to a source. When the voltage of the Q node Q is high, the fourth pull-up TFT UT4 is turned on to output the (n) th phase third clock signal qCLK(n) as a carry signal CARRY(n).

The fourth pull-down TFT DT4 is a pull-down TFT in which the QB node QB is connected to a gate, a low potential driving voltage VSS which is an input is applied to a drain, and the carry signal CARRY(n) line which is an output terminal is connected to a source. When the voltage of the QB node QB is high, the fourth pull-down TFT DT4 is turned on to output the low potential driving voltage VSS as a carry signal CARRY(n).

The first controller is applied with a carry signal CARRY (n−p) of the previous stage and a carry signal CARRY(n+q) of the subsequent stage to control a voltage which is applied to the Q node Q and includes a first QTFT QT1 and a second QTFT QT2.

The first QTFT QT1 is a TFT in which the carry signal CARRY(n−p) of the previous stage is applied to a gate and a drain and a Q node Q is connected to a source. When the carry signal CARRY(n−p) of the previous stage is high, the first QTFT QT1 is turned on to output a high potential driving voltage which is the high carry signal CARRY(n−p) of the previous stage to the Q node Q.

The second QTFT QT2 is a TFT in which the carry signal CARRY(n+q) of the subsequent stage is applied to a gate, a low potential driving voltage VSS which is an input is applied to a drain, and a Q node Q is connected to a source. When the carry signal CARRY(n+q) of the subsequent stage is high, the second QTFT QT2 is turned on to output the low potential driving voltage VSS as the Q node Q.

The second controller may be configured by an inverter IVT in which the above-described Q node Q is connected to an input terminal and the QB node QB is connected to an output terminal. Therefore, an inversed voltage state to that of the Q node Q may be maintained in the QB node by the second controller.

Figure 8:
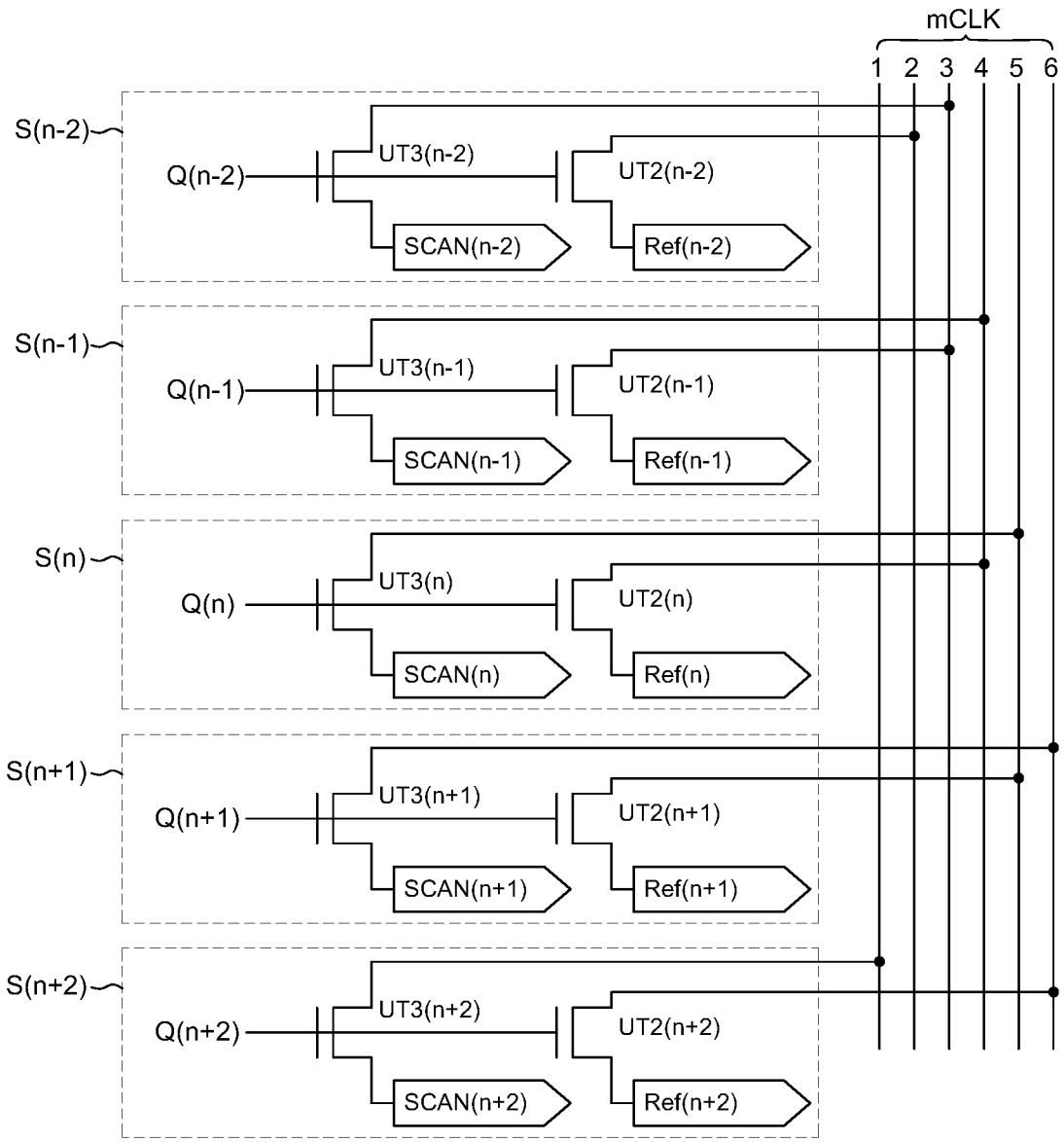
FIG. 8 is a block diagram illustrating a gate driver of a display device according to another exemplary aspect of the present disclosure.

FIG. 8 is a block diagram illustrating a gate driver of a display device according to another exemplary aspect of the present disclosure.

For the convenience of description, in FIG. 8, only a connection relationship of the second pull-up TFT UT2 and the third pull-up TFT UT3 of the (n−2) th stage S(n−2) to n+2-th stage S(n+2) and the first clock signal mCLK line is illustrated.

That is, first clock signals mCLK having different phases from each other are applied to the second pull-up TFT UT2 of the second output unit and the third pull-up TFT UT3 of the third output unit.

A difference between a phase of the first clock signal mCLK applied to the second pull-up TFT UT2 and a phase of the first clock signal mCLK applied to the third pull-up TFT UT3 is determined by a difference of times when the scan signal SCAN(n) and the reference signal Ref(n) are applied to the above-described pixel circuit.

As illustrated in FIG. 8, an (n−1) th phase first clock signal mCLK(n−1) is applied to the second pull-up TFT UT2 of the second output unit and an (n) th phase first clock signal mCLK(n) is applied to the third pull-up TFT UT3 of the third output unit.

Specifically, when the first clock signal mCLK is a 6th phase clock signal, in the (n−2) th stage S(n−2), a second phase first clock signal mCLK2 is applied to the second pull-up TFT UT2($n$−2) and a third phase first clock signal mCLK3 is applied to the third pull-up TFT UT3($n$−2). In the (n−1) th stage S(n−1), the third phase first clock signal mCLK3 is applied to the second pull-up TFT UT2($n$−1) and a fourth phase first clock signal mCLK4 is applied to the third pull-up TFT UT3(*n*−1). In the (n) th stage S(n), the fourth phase first clock signal mCLK4 is applied to the second pull-up TFT UT2(*n*) and a fifth phase first clock signal mCLK5 is applied to the third pull-up TFT UT3(*n*). In the n+1-th stage, the fifth phase first clock signal mCLK5 is applied to the second pull-up TFT UT2(*n*+1) and a sixth phase first clock signal mCLK6 is applied to the third pull-up TFT UT3(*n*+1). In the n+2-th stage, the sixth phase first clock signal mCLK6 is applied to the second pull-up TFT UT2(*n*+2) and the first phase first clock signal mCLK1 is applied to the third pull-up TFT UT3(*n*+2).

That is, the second pull-up TFT UT2(*n*) of the (n) th stage and the third pull-up TFT UT3(*n*−1) of the (n−1) th stage may share the same phase clock signal.

As described above, the clock signals are shared in the gate driver to output the plurality of scan signals and reference signals. Therefore, a gate driver embedded in the display panel is simplified so that a bezel size is reduced and outputs of the scan signal and the reference signal are maintained to be separated in the gate driver so that an output load is reduced, thereby suppressing the delay of the gate signal.

The exemplary aspects of the present disclosure can also be described as follows: According to an aspect of the present disclosure, a gate driver includes a plurality of stages which is dependently connected to each other and each of the plurality of pixels includes: a first output unit which outputs a sensing signal by voltages of a Q node and a QB node; a second output unit which outputs a reference signal by the voltages of the Q node and the QB node; a third output unit which outputs a scan signal by the voltages of the Q node and the QB node; a first controller which controls the Q node; and a second controller which controls the QB node, and at least two of the first to third output units share at least one clock signal among a plurality of clock signals, thereby reducing an area of the gate driver.

The plurality of clock signals may have different pulse widths and different phases from each other.

First clock signals having different phases from each other may be applied to the first output unit and the third output unit and a second clock signal is applied to the second output unit.

An (n−2) th phase first clock signal may be applied to the first output unit and an (n) th phase first clock signal is applied to the third output unit.

The first output unit may include a first pull-up TFT which outputs the (n−2) th phase first clock signal as the sensing signal in accordance with the voltage of the Q node and a first pull-down TFT which outputs a low potential voltage as the sensing signal in accordance with the voltage of the QB node, the second output unit includes a second pull-up TFT which outputs the second clock signal as the reference signal in accordance with the voltage of the Q node and a second pull-down TFT which outputs the low potential voltage as the reference signal in accordance with the voltage of the QB node, and the third output unit includes a third pull-up TFT which outputs the (n) th phase first clock signal as the scan signal in accordance with the voltage of the Q node and a third pull-down TFT which outputs the low potential driving voltage as the scan signal in accordance with the voltage of the QB node.

First clock signals having different phases from each other may be applied to the second output unit and the third output unit and a second clock signal is applied to the first output unit.

An (n−1) th phase first clock signal may be applied to the second output unit and an (n) th phase first clock signal is applied to the third output unit.

The first output unit may include a first pull-up TFT which outputs the second clock signal as the sensing signal in accordance with the voltage of the Q node and a first pull-down TFT which outputs the low potential voltage as the sensing signal in accordance with the voltage of the QB node, the second output unit includes a second pull-up TFT which outputs the (n−1) th phase first clock signal as the reference signal in accordance with the voltage of the Q node and a second pull-down TFT which outputs the low potential voltage as the reference signal in accordance with the voltage of the QB node, and the third output unit includes a third pull-up TFT which outputs the (n) th phase first clock signal as the scan signal in accordance with the voltage of the Q node and a third pull-down TFT which outputs the low potential driving voltage as the scan signal in accordance with the voltage of the QB node.

The first controller may include a first QTFT which outputs a high potential driving voltage to the Q node in accordance with a carry signal of a previous stage and a second QTFT which outputs a low potential driving voltage to the Q node in accordance with a carry signal of a subsequent stage and the second controller includes an inverter in which the Q node is connected to an input terminal and the QB node is connected to an output terminal.

According to another aspect of the present disclosure, an organic light emitting display device includes: a display panel including a plurality of pixels; and a gate driver which is mounted in the display panel and shares at least one clock signal among a plurality of clock signal to output a sensing signal, a reference signal, and a scan signal, thereby reducing an area of the gate driver.

A pixel circuit disposed in the plurality of pixels may include a driving TFT which controls a current flowing in an organic light emitting diode based on voltages which are applied to a gate node and a source node of the driving TFT, a first switching TFT which applies an initialization voltage to a source node of the driving TFT based on the sensing signal, a second switching TFT which applies a reference voltage to a gate node of the driving TFT based on the reference signal, a third switching TFT which applies a data voltage to the gate node of the driving TFT based on the scan signal and a fourth switching TFT which applies a high potential voltage to a drain node of the driving TFT based on an emission control signal.

The gate driver includes a plurality of stages which is dependently connected to each other, and each of the plurality of stages may include a first output unit which outputs the sensing signal by voltages of a Q node and a QB node, a second output unit which outputs the reference signal by the voltages of the Q node and the QB node, a third output unit which outputs the scan signal by the voltages of the Q node and the QB node, a first controller which controls the Q node and a second controller which controls the QB node, and at least two of the first to third output units share at least one clock signal among a plurality of clock signals.

The plurality of clock signals may have different pulse widths and different phases from each other.

First clock signals having different phases from each other may be applied to the first output unit and the third output unit and a second clock signal is applied to the second output unit.

An (n−2) th phase first clock signal may be applied to the first output unit and an (n) th phase first clock signal is applied to the third output unit.

The first output unit may include a first pull-up TFT which outputs the (n−2) th phase first clock signal as the sensing signal in accordance with the voltage of the Q node and a first pull-down TFT which outputs a low potential voltage as the sensing signal in accordance with the voltage of the QB node, the second output unit includes a second pull-up TFT which outputs the second clock signal as the reference signal in accordance with the voltage of the Q node and a second pull-down TFT which outputs the low potential voltage as the reference signal in accordance with the voltage of the QB node, and the third output unit includes a third pull-up TFT which outputs the (n) th phase first clock signal as the scan signal in accordance with the voltage of the Q node and a third pull-down TFT which outputs the low potential driving voltage as the scan signal in accordance with the voltage of the QB node.

First clock signals having different phases from each other may be applied to the second output unit and the third output unit and a second clock signal is applied to the first output unit.

An (n−1) th phase first clock signal may be applied to the second output unit and an (n) th phase first clock signal is applied to the third output unit.

The first output unit may include a first pull-up TFT which outputs the second clock signal as the sensing signal in accordance with the voltage of the Q node and a first pull-down TFT which outputs the low potential voltage as the sensing signal in accordance with the voltage of the QB node, the second output unit includes a second pull-up TFT which outputs the (n−1) th phase first clock signal as the reference signal in accordance with the voltage of the Q node and a second pull-down TFT which outputs the low potential voltage as the reference signal in accordance with the voltage of the QB node, and the third output unit includes a third pull-up TFT which outputs the (n) th phase first clock signal as the scan signal in accordance with the voltage of the Q node and a third pull-down TFT which outputs the low potential driving voltage as the scan signal in accordance with the voltage of the QB node.

The first controller may include a first QTFT which outputs a high potential driving voltage to the Q node in accordance with a carry signal of a previous stage and a second QTFT which outputs a low potential driving voltage to the Q node in accordance with a carry signal of a subsequent stage and the second controller includes an inverter in which the Q node is connected to an input terminal and the QB node is connected to an output terminal.

Although the exemplary aspects of the present disclosure have been described in detail with reference to the accompanying drawings, the present disclosure is not limited thereto and may be embodied in many different forms without departing from the technical concept of the present disclosure. Therefore, the exemplary aspects of the present disclosure are provided for illustrative purposes only but not intended to limit the technical concept of the present disclosure. The scope of the technical concept of the present disclosure is not limited thereto. Therefore, it should be understood that the above-described exemplary aspects are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A gate driver including a plurality of stages dependently connected to each other, each stage comprising:

a first output unit which outputs a sensing signal in accordance with voltages of a Q node and a QB node;

a second output unit which outputs a reference signal in accordance with the voltages of the Q node and the QB node;

a third output unit which outputs a scan signal in accordance with the voltages of the Q node and the QB node;

a first controller which controls the Q node; and a second controller which controls the QB node, wherein at least two of the first to third output units share at least one clock signal among a plurality of clock signals, wherein the first output unit includes a first pull-up TFT which outputs a (n−2) th phase first clock signal as the sensing signal in accordance with the voltage of the Q node and a first pull-down TFT which outputs a low potential voltage as the sensing signal in accordance with the voltage of the QB node, wherein the second output unit includes a second pull-up TFT which outputs a second clock signal as the reference signal in accordance with the voltage of the Q node and a second pull-down TFT which outputs the low potential voltage as the reference signal in accordance with the voltage of the QB node, and wherein the third output unit includes a third pull-up TFT which outputs a (n) th phase first clock signal as the scan signal in accordance with the voltage of the Q node and a third pull-down TFT which outputs the low potential driving voltage as the scan signal in accordance with the voltage of the QB node.

2. The gate driver according to claim 1, wherein the plurality of clock signals has different pulse widths and different phases from each other.

3. A gate driver including a plurality of stages dependently connected to each other, each stage comprising:

a first output unit which outputs a sensing signal in accordance with voltages of a Q node and a QB node;

a second output unit which outputs a reference signal in accordance with the voltages of the Q node and the QB node;

a third output unit which outputs a scan signal in accordance with the voltages of the Q node and the QB node;

a first controller which controls the Q node; and a second controller which controls the QB node, wherein at least two of the first to third output units share at least one clock signal among a plurality of clock signals, wherein the second output unit and the third output unit are supplied with first clock signals having different phases from each other and the first output unit is supplied with a second clock signal, wherein the second output unit is supplied with an (n−1) th phase first clock signal and the third output unit is supplied with an (n) th phase first clock signal, wherein the first output unit includes a first pull-up TFT which outputs the second clock signal as the sensing signal in accordance with the voltage of the Q node and a first pull-down TFT which outputs the low potential voltage as the sensing signal in accordance with the voltage of the QB node, the second output unit includes a second pull-up TFT which outputs the (n−1) th phase first clock signal as the reference signal in accordance with the voltage of the Q node and a second pull-down TFT which outputs the low potential voltage as the reference signal in accordance with the voltage of the QB node, and the third output unit includes a third pull-up TFT which outputs the (n) th phase first clock signal as the scan signal in accordance with the voltage of the Q node and a third pull-down TFT which outputs the low potential driving voltage as the scan signal in accordance with the voltage of the QB node.

4. A gate driver including a plurality of stages dependently connected to each other, each stage comprising:

a first output unit which outputs a sensing signal in accordance with voltages of a Q node and a QB node;

a second output unit which outputs a reference signal in accordance with the voltages of the Q node and the QB node;

a third output unit which outputs a scan signal in accordance with the voltages of the Q node and the QB node;

a first controller which controls the Q node; and a second controller which controls the QB node, wherein at least two of the first to third output units share at least one clock signal among a plurality of clock signals, wherein the first controller includes:

a first QTFT which outputs a high potential driving voltage to the Q node in accordance with a carry signal of a previous stage; and a second QTFT which outputs a low potential driving voltage to the Q node in accordance with a carry signal of a subsequent stage, wherein the second controller includes an inverter in which the Q node is connected to an input terminal and the QB node is connected to an output terminal.

5. An organic light emitting display device, comprising:

a display panel including a plurality of pixels; and a gate driver which is mounted in the display panel, shares at least one clock signal among a plurality of clock signals and outputs a sensing signal, a reference signal, and a scan signal wherein the gate driver includes a plurality of stages which is dependently connected to each other, and each of the plurality of stages includes:

a first output unit which outputs the sensing signal in accordance with voltages of a Q node and a QB node;

a second output unit which outputs the reference signal in accordance with the voltages of the Q node and the QB node;

a third output unit which outputs the scan signal in accordance with the voltages of the Q node and the QB node;

a first controller which controls the Q node; and a second controller which controls the QB node, wherein at least two of the first to third output units share at least one clock signal among a plurality of clock signals and wherein the first output unit includes a first pull-up TFT which outputs a second clock signal as the sensing signal in accordance with the voltage of the Q node and a first pull-down TFT which outputs a low potential voltage as the sensing signal in accordance with the voltage of the QB node, wherein the second output unit includes a second pull-up TFT which outputs a (n−1) th phase first clock signal as the reference signal in accordance with the voltage of the Q node and a second pull-down TFT which outputs the low potential voltage as the reference signal in accordance with the voltage of the QB node, and wherein the third output unit includes a third pull-up TFT which outputs a (n) th phase first clock signal as the scan signal in accordance with the voltage of the Q node and a third pull-down TFT which outputs the low potential driving voltage as the scan signal in accordance with the voltage of the QB node.

6. The organic light emitting display device according to claim 5, wherein the plurality of clock signals has different pulse widths and different phases from each other.

7. The organic light emitting display device according to claim 5, wherein the first controller includes:

a first QTFT which outputs a high potential driving voltage to the Q node in accordance with a carry signal of a previous stage; and a second QTFT which outputs a low potential driving voltage to the Q node in accordance with a carry signal of a subsequent stage, wherein the second controller includes an inverter in which the Q node is connected to an input terminal and the QB node is connected to an output terminal.

8. An organic light emitting display device, comprising:

a display panel including a plurality of pixels; and a gate driver which is mounted in the display panel, shares at least one clock signal among a plurality of clock signals and outputs a sensing signal, a reference signal, and a scan signal, wherein a pixel circuit disposed in the plurality of pixels includes:

a driving TFT which controls a current flowing in an organic light emitting diode based on voltages which are applied to a gate node and a source node of the driving TFT;

a first switching TFT which applies an initialization voltage to the source node of the driving TFT based on the sensing signal;

a second switching TFT which applies a reference voltage to the gate node of the driving TFT based on the reference signal;

a third switching TFT which applies a data voltage to the gate node of the driving TFT based on the scan signal; and a fourth switching TFT which applies a high potential voltage to a drain node of the driving TFT based on an emission control signal.

9. An organic light emitting display device, comprising:

a display panel including a plurality of pixels; and a gate driver which is mounted in the display panel, shares at least one clock signal among a plurality of clock signals and outputs a sensing signal, a reference signal, and a scan signal, wherein the gate driver includes a plurality of stages which is dependently connected to each other, and each of the plurality of stages includes:

a first output unit which outputs the sensing signal in accordance with voltages of a Q node and a QB node;

a second output unit which outputs the reference signal in accordance with the voltages of the Q node and the QB node;

a third output unit which outputs the scan signal in accordance with the voltages of the Q node and the QB node;

a first controller which controls the Q node; and a second controller which controls the QB node, wherein at least two of the first to third output units share at least one clock signal among a plurality of clock signals, wherein the first output unit and the third output unit are supplied with first clock signals having different phases from each other and the second output unit is supplied with a second clock signal, wherein the first output unit is supplied with an (n−2) th phase first clock signal and the third output unit is supplied with an (n) th phase first clock signal, wherein the first output unit includes a first pull-up TFT which outputs the (n−2) th phase first clock signal as the sensing signal in accordance with the voltage of the Q node and a first pull-down TFT which outputs a low potential voltage as the sensing signal in accordance with the voltage of the QB node, wherein the second output unit includes a second pull-up TFT which outputs the second clock signal as the reference signal in accordance with the voltage of the Q node and a second pull-down TFT which outputs the low potential voltage as the reference signal in accordance with the voltage of the QB node, and wherein the third output unit includes a third pull-up TFT which outputs the (n) th phase first clock signal as the scan signal in accordance with the voltage of the Q node and a third pull-down TFT which outputs the low potential driving voltage as the scan signal in accordance with the voltage of the QB node.

* * * * *